United States Patent [19]

Kuehnle et al.

[11] 4,322,488

[45] Mar. 30, 1982

[54] DEVELOPING LATENT ELECTROSTATIC IMAGES USING A LIQUID TONER AND A DEVELOPMENT ELECTRODE

[75] Inventors: Manfred R. Kuehnle, Lexington, Mass.; John R. Manhardt, Nashua, N.H.; Malor Wright, Lincoln, Mass.

[73] Assignee: Coulter Systems Corporation, Bedford, Mass.

[21] Appl. No.: 116,953

[22] Filed: Jan. 30, 1980

Related U.S. Application Data

[63] Continuation of Ser. No. 898,729, Apr. 24, 1978, abandoned.

[51] Int. Cl.[3] ..... G03G 13/10

[52] U.S. Cl. ..... 430/103; 430/119

[58] Field of Search ..... 430/103, 113, 119; 118/647, 648, 649, 650, 651

[56] References Cited

U.S. PATENT DOCUMENTS

| | | | |
|---|---|---|---|
| 3,346,475 | 10/1967 | Metkan et al. | 430/103 |
| 3,811,764 | 5/1974 | Forest | 430/35 |
| 4,076,406 | 2/1978 | Talmage et al. | 430/103 |

*Primary Examiner*—Richard L. Schilling
*Assistant Examiner*—John L. Goodrow
*Attorney, Agent, or Firm*—Silverman, Cass & Singer, Ltd.

[57] ABSTRACT

A method and apparatus for developing a latent electrostatic image on the surface of an electrophotographic member using a liquid toner and a development electrode. An AC bias voltage is applied between the electrophotographic member and the development electrode during the developing operation to prevent the formation of spatially stable convection cells in the liquid toner.

10 Claims, 3 Drawing Figures

DEVELOPING LATENT ELECTROSTATIC IMAGES USING A LIQUID TONER AND A DEVELOPMENT ELECTRODE

This is a continuation of application Ser. No. 898,729 filed Apr. 24, 1978, now abandoned.

BACKGROUND OF THE INVENTION

This invention relates to developing latent electrostatic images and, more particularly, to developing latent electrostatic images using a liquid toner and a development electrode.

It is well known to form a latent electrostatic image on the surface of an electrophotographic member by first applying a uniform electrostatic charge to the surface and then exposing the surface to a pattern of light. It is also well known to develop a latent electrostatic image formed on the surface of an electrophotographic member before it has deteriorated by treatment with a toner.

The two types of toners most frequently used in developing latent electrostatic images are liquid toners and dry powder toners. Liquid toners, which appear to be necessary for high spatial resolution, are made up essentially of small pigmented particles, called toner particles, dispersed in an insulating liquid. When a liquid toner is brought into contact with a surface containing a latent electrostatic image, such as by immersing the surface in a chamber containing liquid toner, the toner particles in the liquid migrate to the surface and deposit on the image bearing portions through a phenomenon known as electrophoresis.

When it is desired to reproduce a continuous tone image or an image containing a solid area a device known as a development electrode is usually employed to assist in the developing operation. The development electrode consists basically of a flat electrically conductive plate. The plate is positioned close to and parallel to the image bearing surface. The effect of the development electrode is to change the field configuration of the electrostatic image and to increase the field in the space above areas of uniform charge. The development electrode has the further effect of intensifying the electrical field near the image bearing surface. Normally, the development electrode is electrically shorted to the electrophotographic member; however, for special effects such as reversal toning or fog reduction a DC potential difference is often maintained between the development electrode and the electrophotographic member.

One of the problems with liquid toners is that they have a tendency to generate spatially stable convection cells during the developing operation when used with a development electrode. These convection cells, which are generally spherically shaped, are formed over a range of field strengths and have the effect of shielding portions of the surface of the electrophotographic member from coming into contact with the toner particles. As a result of the convection cells, a cellular shaped optical density pattern which is superimposed over the image pattern, is visible in the developed image. The size of the convection cells which may be formed is dependent on the field strength, the volume concentration of toner particles, and the spacing between the surface and the development electrode. The range of field strengths over which the convection cells may be formed may vary depending on the composition of the particular liquid toner. It is believed that the convection cells are formed as a result of hydrodynamic instability in liquid toners.

It has been suggested that the generation of these convection cells could be avoided by performing the developing operation at field strengths outside the range at which the cells have a tendency to form. This could be achieved by changing the spacing between the electrophotographic member and the development electrode since the field strength varies directly with voltage on the photoconductive surface of the electrophotographic member and inversely with the distance between the development electrode and the electrophotographic member. For most electrophotographic members, however, the range of field strengths necessary to produce good continuous tone images or good images containing solid areas is within the range or includes at least some part of the range of field strengths over which the cells are generated.

It is the general purpose of this invention to provide a technique for preventing the formation of the above described convection cells and thereby promote uniform deposition of toner particles in areas of uniform charge density.

SUMMARY OF THE INVENTION

According to the teachings of this invention, the generation of convection cells in a liquid toner when used with a development electrode to develop an electrostatic image on an electrophotographic member is prevented without adversely effecting sensitometry, image detail or developing time, by applying an AC bias voltage between the electrophotographic member and the development electrode during the developing operation.

It is believed that the AC bias voltage eliminates the hydrodynamic instability of the liquid toner which produces the convection cells by interrupting or disturbing the otherwise unidirectional movement of the charged toner particles to the photoconductive surface. These interruptions or disturbances result in changes in direction of the forces exerted by the particles on the liquid in which the particles are suspended.

The AC bias waveform is preferably symmetrically shaped. The range of frequencies and amplitudes of the AC bias over which formation of the convection cells is either prevented or reduced to some noticeable extent is dependent on the particular liquid toner employed, the distance between the electrophotographic member and the development electrode and the maximum charge voltage on the electrophotographic member.

If the frequency of the AC bias is either too high or too low the resulting changes in the direction of movement of the toner particles will have insufficient effect on the direction of movement of the insulating liquid and consequently, will not prevent the generation of the convection cells. If the amplitude of the AC bias is too low it will not effect the movement of the toner particles which control the movement of the insulating liquid. If the amplitude of the AC bias is too high it will prevent generation of the convection cells but will also prevent the toner particles from depositing on the surface of the electrophotographic member.

Preferably, the half-wave amplitude of the AC bias should be equal to at least the maximum charge voltage on the photoconductive surface. If the amplitude is not up to this level, the bias voltage will not interrupt the movement of the toner particles sufficiently to prevent the generation of the convection cells in the higher voltage image areas. The effectiveness of the AC bias also depends on its waveform. For a given frequency and amplitude, a square waveform is more effective in inhibiting formation of convection cells than a sinusoidal waveform, and a sinusoidal waveform is more effective than a triangular waveform. It has been found, however, that any waveform may be used to prevent formation of convection cells by suitable adjustment of the AC frequency and/or amplitude.

For every combination of electrophotographic member, charge voltage, liquid toner, and physical arrangement, there exists an optimum combination of AC bias amplitude, frequency, and waveform which can prevent formation of the convection cells believed responsible for the objectionable cellular optical density pattern in uniformly-charged image areas. The optimum combination can readily be ascertained by anyone skilled in the art.

IN THE DRAWINGS

FIG. 1 is a diagrammatic sectional view of an apparatus for developing a latent electrostatic image on the surface of an electrophotographic member according to the teachings of this invention, some of the parts being drawn out of proportion for ease in viewing;

FIG. 2 is a photomicrograph enlarged ten times, showing the cellular density pattern formed on an image developed with a liquid toner and a development electrode as a result of convection cells being generated in the liquid toner during the developing process; and FIG. 3 is a photomicrograph enlarged ten times showing how the cellular pattern referred to above is greatly reduced by applying the teachings of this invention.

DESCRIPTION OF PREFERRED EMBODIMENTS

Figure 1:
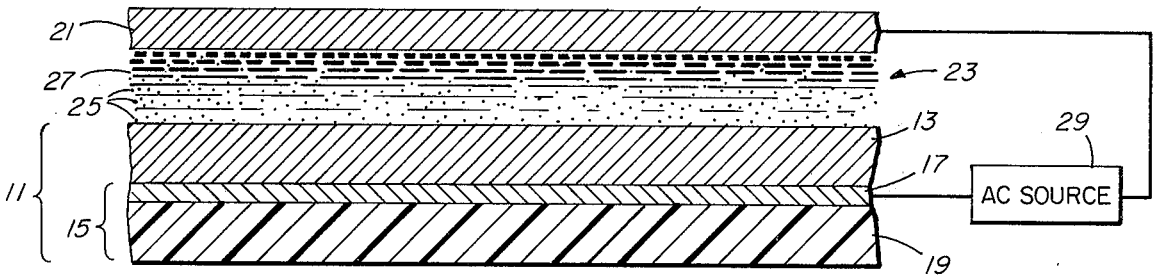

Referring to FIG. 1, there is shown an electrophotographic member identified generally by reference numeral 11. Electrophotographic member 11 includes a photoconductive layer 13 and a conductive substrate 15. The conductive substrate 15 includes a conductive layer 17 and a base or carrier 19. Photoconductive layer 13 may be, for example, RF sputtered cadmium sulfide and conductive substrate 15 may be a layer of indium-tin-oxide on a polyester or other plastic base. An electrophotographic member of this type is described in U.S. Pat. No. 4,025,339 to M. R. Kuehnle.

A development electrode 21 for use in assisting in developing a latent electrostatic image on the surface of photoconductive layer 13 is positioned above the electrophotographic member 11 and a quantity of a liquid toner type developer 23 is in the space between the electrophotographic member 11 and the development electrode 21. The liquid toner 23, which is confined in a chamber (not shown), includes toner particles 25 suspended in a non-conductive liquid 27. The particular liquid toner employed is dependent upon the characteristics of the particular electrophotographic member. If the electrophotographic member is of the type described in the above noted U.S. Pat. No. 4,025,339 to M. R. Kuehnle the liquid toner may comprise a comminuted powder of carbon and resin dispersed in an isoparaffinic hydrocarbon fraction available from the Exxon Company of Houston, Tex., under the name of "Isopar".

According to the teachings of this invention an AC source 29 is connected between the development electrode 21 and the conductive layer 17 to provide an AC voltage bias between the two members. The AC voltage bias is applied between these two members to prevent the formation of convection cells in the liquid toner. The AC bias voltage is applied at least during the time period the liquid toner is disposed between the two members and in the process of developing the electrostatic image.

The invention will be more fully appreciated with reference to the following examples.

EXAMPLE I

Figure 2:
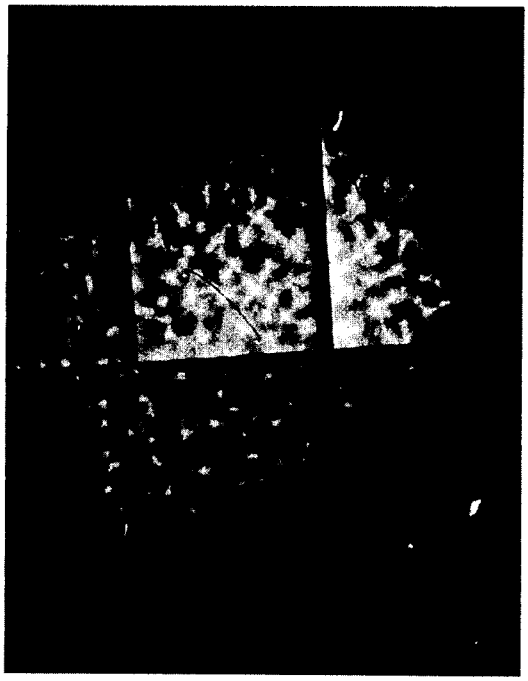

An electrophotographic member containing an RF sputtered cadmium sulfide photoconductive layer as described in the above mentioned patent was uniformly corona charged to a negative surface potential of 25 volts, contacted with a grainless step tablet, exposed to a Xenon discharge light pulse and then developed for a period of about 15 seconds using a liquid toner comprising a comminuted powder of carbon and resin dispersed in Isopar and a development electrode that was parallel to, and spaced 0.010 inches from, the photoconductive surface of the electrophotographic member. Throughout the developing operation the development electrode and the electrophotographic member were both held at ground potential. The developed image contained a severe cellular density pattern superimposed on the image pattern. A photomicrograph of the developed image is shown in FIG. 2.

EXAMPLE II

Figure 3:
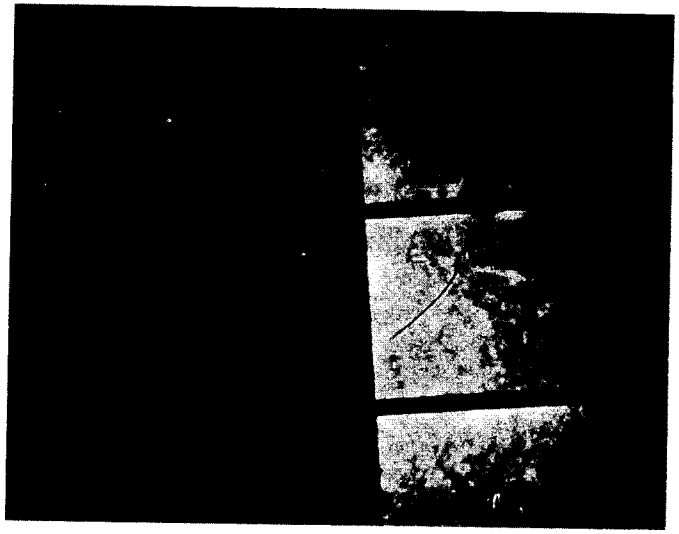

Example I was repeated, except that during the developing operation a symmetrical sinusoidal AC bias having a peak-to-peak amplitude of 50 volts and a frequency of 44 Hz and a DC level of 0 volts was applied between the development electrode and the electrophotographic member. The substantial reduction in the cellular density pattern is shown in FIG. 3.

EXAMPLE III

Example I was again repeated except that the electrophotographic member was charged to a negative surface potential of 10 volts, the AC bias voltage had a peak-to-peak amplitude of 68 volts and a frequency of 7.5 Hz, and the liquid toner was diluted by a factor of 2. The cellular density pattern was completely eliminated.

EXAMPLES IV THROUGH VIII

An electrophotographic member of the same type as used in Example I was uniformly corona charged to a negative surface potential of 15 volts and exposed to an image light pattern. The member was then developed for a period of about 15 seconds using a liquid toner and a development electrode that was parallel to, and spaced 0.015 inches from the photoconductive surface of the electrophotographic member. The liquid toner was comprised of a comminuted powder of carbon and resin dispersed in Isopar, but having no fixing resin as in Example I. The following table shows the results when no bias voltage was applied and then when square wave bias voltage of different frequencies and amplitudes were applied.

| EX-AMPLE | AC FRE-QUENCY | PEAK-TO-PEAK AC AMPLITUDE | CELLULAR DENSITY PATTERN |
|---|---|---|---|
| IV | NO BIAS VOLTAGE | | PRESENT |
| V | 5 HZ | 50 VOLTS | ELIMINATED |
| VI | 10 HZ | 50 VOLTS | ELIMINATED |
| VII | 10 HZ | 25 VOLTS | ELIMINATED |

Example VII shows that the AC bias effectively removed the cellular density pattern even though the peak-to-peak voltage was less than the surface potential on the photoconductive surface of the electrophotographic member.

It can be appreciated that the concept of applying an AC bias voltage to prevent the formation of convection cells in a liquid toner which is dispersed between two parallel conductive members can find use also in electrophoretic display devices wherein a quantity of liquid toner is disposed between two parallel electrodes which are connected to voltage sources of different polarity.

Many variations are readily achieved without departing from the spirit and scope of the invention as defined in the appended claims. For example, the AC bias voltage applied according to the teachings of this invention may be superimposed over a DC bias voltage applied for some other purpose, such as reversal toning.

What is claimed is:

1. A method of preventing the formation of voids developed on a toned electrostatic image during development as a result of the unrestricted formation of Bénard type convection cells during electrophotographic development of a latent electrostatic image formed on the surface of an electrophotographic member using a liquid toner formed of toner particles suspended in an insulating liquid and a development electrode, the insulating liquid being hydrodynamically unstable during toning, the hydrodynamic instability being effected by movement of the toner particles through said insulating liquid under the influence of the electric field forces between said electrophotographic member and the development electrode, propulsion of said toner particles effecting a concurrent movement of the insulating liquid whereby a body thereof is carried with each particle as a trailing body of insulating liquid to define spatially stable Bénard type convection cells therewithin; the improvement comprising applying an AC bias voltage between the development electrode and the electrophotographic member across the liquid toner during the developing operation changing the direction of the electric field forces exerted on the particles by said electric field impelling those particles through the insulating liquid materially inhibiting the formation of said spatially stable Bénard type convection cells within the said toner suspension whereby to be non-interferent with accumulation of toner particles on the surface of the electrophotographic member primarily dependent upon the field strength of said latent electrostatic image.

2. The improvement as claimed in claim 1 and the waveform of the AC bias voltage is of uniform configuration.

3. The improvement as claimed in claim 1 and wherein the waveform of the AC bias voltage is sinusoidal.

4. The method as claimed in claim 1 and wherein the waveform of the AC bias voltage is rectangular.

5. The improvement as claimed in claim 1 and wherein the peak-to-peak amplitude of the AC bias voltage is at least about twice as great as the maximum charge voltage on the electrophotographic member.

6. The improvement as claimed in claim 1 and wherein the AC bias voltage is applied continuously during the developing operation.

7. The improvement as claimed in claim 1 and wherein the peak-to-peak amplitude of the AC bias voltage is about 50 volts.

8. The improvement as claimed in claim 1 and wherein the peak-to-peak amplitude of the AC bias is about 18 volts and the frequency is about 7.5 Hz.

9. The improvement as claimed in claim 1 and wherein the liquid toner comprises a comminuted powder of carbon and resin dispersed in an isoparaffinic hydrocarbon fraction, the distance between the development electrode and the electrophotographic member is about 0.010 inches and the AC bias voltage has a peak-to-peak amplitude of about 50 volts and a frequency of about 44 Hz.

10. A method of preventing the formation of voids developed on a toned electrostatic image during development as a result of the unrestricted formation of Bénard type convection cells during electrophotographic development of a continuous tone image or an image having a solid area by electrostatic imaging techniques wherein an electrophotographic member is provided, an electrostatic image is formed on said member corresponding to the image to be reproduced, a development electrode is spaced above said member, a quantity of a suspension of toner particles in an insulating liquid is brought into contact with said member between said member and the development electrode and an electric field is developed thereacross for a period of time sufficient to develop the electrostatic image on said member, the insulating liquid being hydrodynamically unstable during the development process, the hydrodynamic instability being effected by the movement of the toner particles through said insulating liquid, propulsion of said particles carrying therealong a trailing body of insulating liquid thereby to define spatially stable Bénard type convection cells therewithin, said method of void prevention comprising applying an AC bias voltage between the member and the development electrode only during the period of time that the electrostatic image is being developed and subsequent to the formation of the said electrostatic image changing the direction of the forces exerted on the particles by the electrical field substantially preventing the formation of said spatially stable Bénard type convection cells within said insulating liquid whereby to be non-interferent with accumulation of toner particles on the surface of the electrophotographic member primarily dependent upon the field strength of said latent electrostatic image.

* * * * *